US006419377B1

(12) United States Patent
Yuen

(10) Patent No.: US 6,419,377 B1
(45) Date of Patent: Jul. 16, 2002

(54) SWIVEL LANTERN

(76) Inventor: Se Kit Yuen, 6F Yau Lee Centre, 45 Hoi Yuen Road, Kwun Tong, Kowloon (HK)

( * ) Notice: Subject to any disclaimer, the term of this patent is extended or adjusted under 35 U.S.C. 154(b) by 0 days.

(21) Appl. No.: 09/765,523

(22) Filed: Jan. 19, 2001

(51) Int. Cl.[7] ..... F21V 21/08

(52) U.S. Cl. ..... 362/399; 362/197; 362/199; 362/418; 362/427

(58) Field of Search ..... 362/197, 199, 362/399, 418, 427; 439/36; 403/17; 16/110.1, 900

(56) References Cited

U.S. PATENT DOCUMENTS 1,180,669 A * 4/1916 Oellrich et al. ..... 16/334
1,699,927 A * 1/1929 Stearns ..... 362/199
1,820,960 A * 9/1931 Champagne et al. ..... 362/197
1,986,281 A * 1/1935 Nygard ..... 200/551
2,205,163 A * 6/1940 Blau ..... 362/199
4,734,832 A * 3/1988 Moriano et al. ..... 335/205
5,019,951 A * 5/1991 Osterhout et al. ..... 362/191
5,349,512 A * 9/1994 Parker ..... 362/191
5,541,822 A * 7/1996 Bamber ..... 429/34
5,713,441 A * 2/1998 Chen ..... 16/113.1
5,993,022 A * 11/1999 Neyer et al. ..... 362/199
6,216,317 B1 * 4/2001 Chen ..... 16/430
6,260,985 B1 * 7/2001 Zeller ..... 362/157

* cited by examiner

*Primary Examiner*—Sandra O'Shea
*Assistant Examiner*—Ismael Negron
(74) *Attorney, Agent, or Firm*—Raymond Y. Chan; David and Raymond Patent Group

(57) ABSTRACT

A spotlight with locking swivel-join handle includes a lamp head, a handle, a swivel joint for rotatably connecting the handle with the lamp head, and a releasable locking means for selectively locking the handle in a pistol type handle position and a transversal type handle position with respect to the lamp head, wherein in the pistol type handle position, the handle is sidewardly and radially extended from the lamp head, and in the transversal type handle position, the handle is sidewardly extended in parallel with an axis of the lamp head. Therefore, the spotlight is capable of being worked as an above-head type lantern and a below-waist type lantern.

27 Claims, 10 Drawing Sheets

SWIVEL LANTERN

BACKGROUND OF THE PRESENT INVENTION

1. Field of Invention

The present invention relates to spotlight, and more particularly to a swivel lantern which is a lantern lamp having a handle adjustable between a pistol type handle position and a transversal type handle position to fit various usages.

2. Description of Related Arts

Lantern is a kind of popular spotlights because it can be used as outdoor lighting means in many circumstances, such as during outdoor camping, finishing, and hunting. The lanterns may be used in times of power outage or in the road side anywhere in the city while the car is dead on road. Lanterns can also be used in industries such as automobile repair shop where lighting for the underneath of automobiles is required. Therefore, consumers nowadays require different types of lantern for different usages. Lanterns, according to its natures and features, can normally be divided into three major categories and two major types.

There are three major categories of conventional lanterns in market. They are A/C powered, D/C powered and powered by the battery of an automobile (usually it is a 12V power supply). Moreover, there are two major types of conventional lanterns providing different usages, i.e. the above-head type lantern and below-waist type lantern. However, they all have problems and disadvantages regardless of the different power supplies and the usages.

Referring to FIG. 1, a conventional above-head type lantern A having a pistol type handle 1A integrally connected to a bottom portion of the lamp head 2A is illustrated, which is generally used in environments, such as patrol searching, where the lamp head 2A is required to be held in an above head position. Normally, the user needs to use one hand to hold the lantern while using another free hand to do whatever tasks he wants to do. If the task requires the user to perform some complicated tasks that require the user to use both hands or even require the user to use additional tools to complete the task, the user will has no other alternative but to have another person to hold lantern for him. It is very inconvenient and does not make any economical sense in term of the daily business operations.

As shown in FIG. 1, the conventional below-waist type lantern B having a transversal type handle 1B integrally connected to a top portion of the lamp head 2B is illustrated, which is generally used in environments where the lamp head 2B is required to be held in a below waist position. Moreover, the transversal type handle 1B allows the user to sit on ground and hang the lantern in some areas where permissible, such as the hook in the lower front bumper of a Sport Utility Vehicle (SUV), or the front top rack of a camping tent.

In other words, although both the above-head type lantern A and the below-waist type lantern B are spotlights, they provide different conveniences for different applications respectively. Since it does not make sense for a user to pay double price to own both types of lantern at the same time, most users will choose to unwillfully select one of them to buy and suffer the possible disadvantages for some usages.

SUMMARY OF THE PRESENT INVENTION

A main objective of the present invention of a swivel lantern which can be worked and functioned as an above-head type lantern and a below-waist type lantern. The swivel lantern of the present invention using a swivel joint to connect the handle with the lamp head that enables the handle to be adjusted between a pistol type handle position and a transversal type handle position with respect to the lamp head.

Another objective of the swivel lantern according to the present invention is to provide a releasable locking means in low cost and effective structure for firmly locking up both the pistol type handle position and the transversal type handle position, wherein the locking means can easily be released while switching between the pistol type handle position and the transversal type handle position.

In order to accomplish the above objectives, the present invention provides a swivel lantern which comprises:

a lamp head, a handle, a swivel joint for rotatably connecting the handle with the lamp head, and a releasable locking means for selectively locking the handle in a pistol type handle position and a transversal type handle position with respect to the lamp head, wherein in the pistol type handle position, the handle is sidewardly and radially extended from the lamp head, and in the transversal type handle position, the handle is sidewardly extended in parallel with an axis of the lamp head.

DETAILED DESCRIPTION OF THE PREFERRED EMBODIMENT

Referring to FIGS. 3 to 7, a swivel lantern 10 according to a preferred embodiment of the present invention is illustrated, which is adjustable to work and function as an above-head type lantern and a below-waist type lantern.

Figure 1:
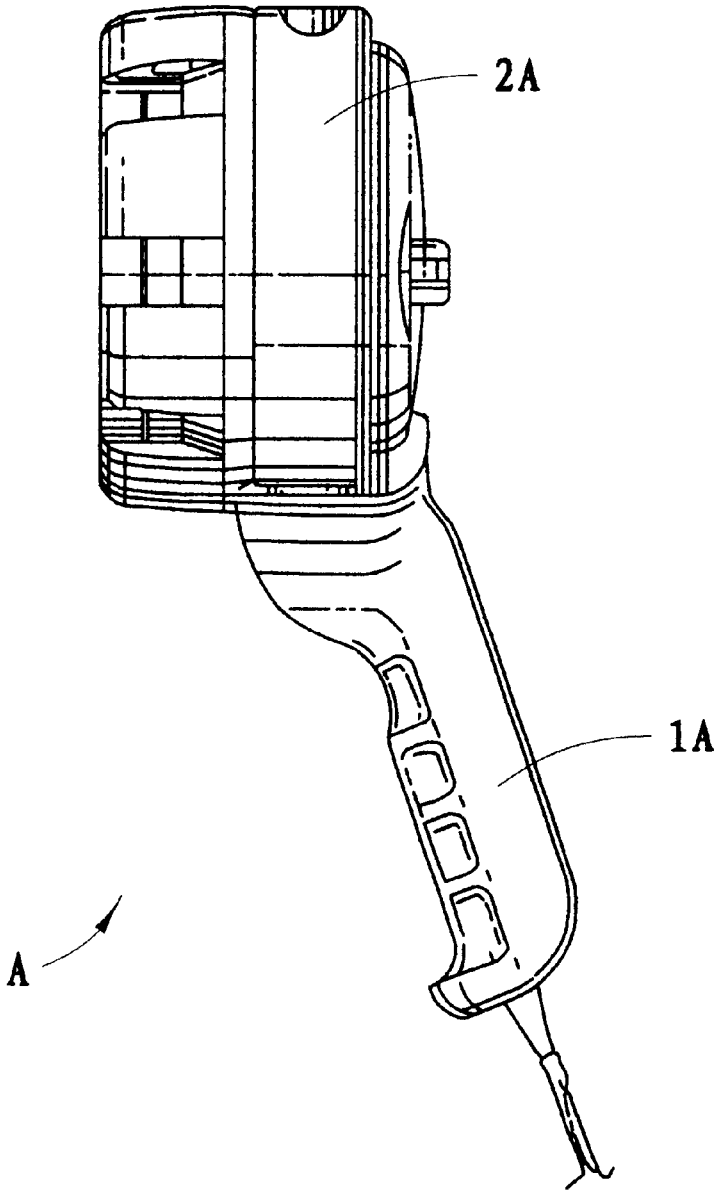
FIG. 1 PRIOR ART
FIG. 1 is a side view of the conventional above-head type lantern.
Figure 2:
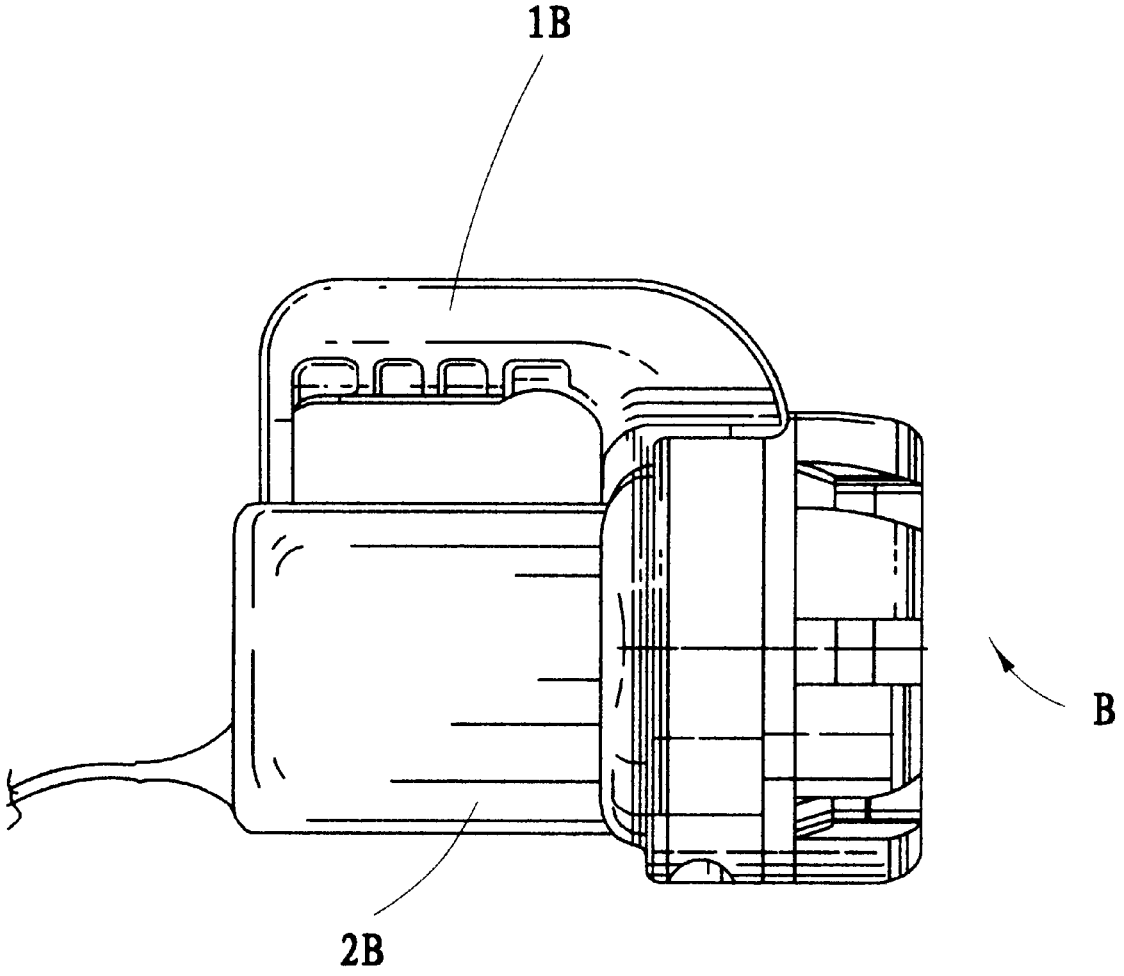
FIG. 2 PRIOR ART
FIG. 2 is a side view of the conventional below-waist type lantern.
Figure 3:
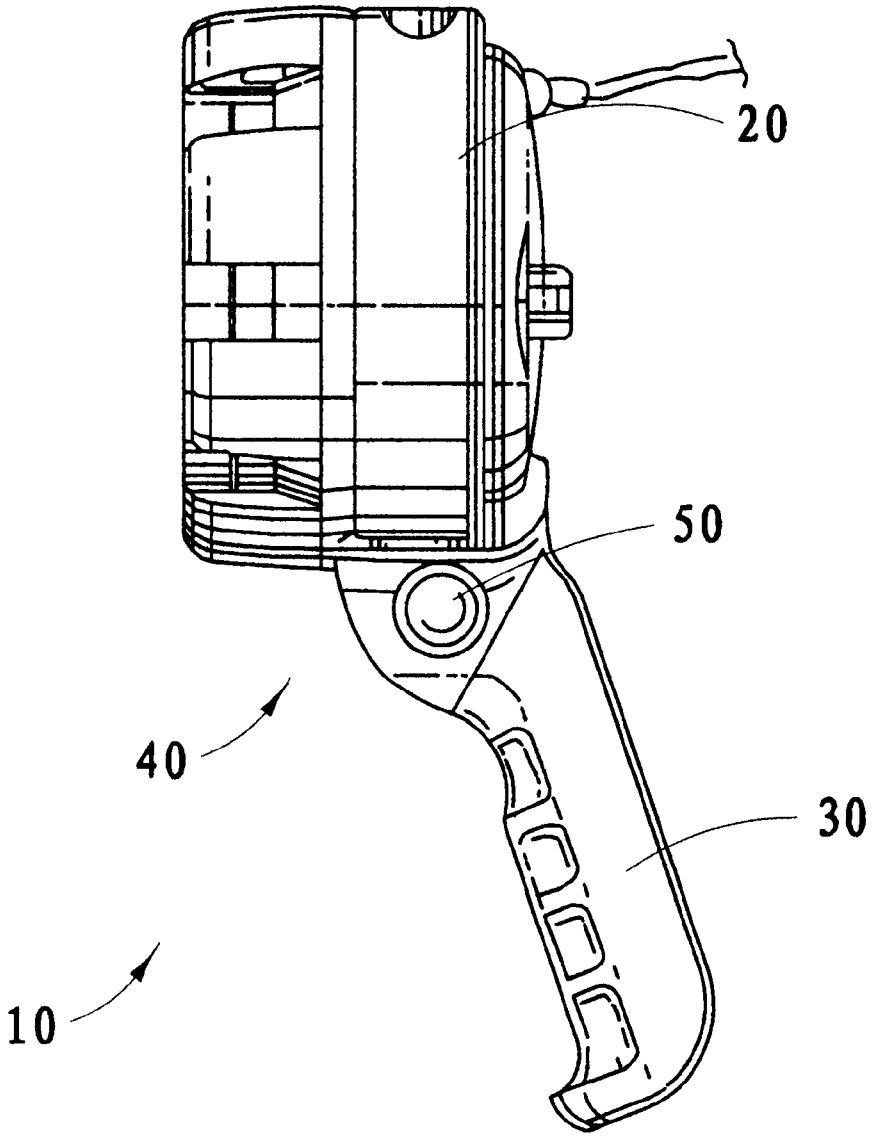
FIG. 3 is a side view of a swivel lantern, in a pistol type handle position, according to a preferred embodiment of the present invention.
Figure 4:
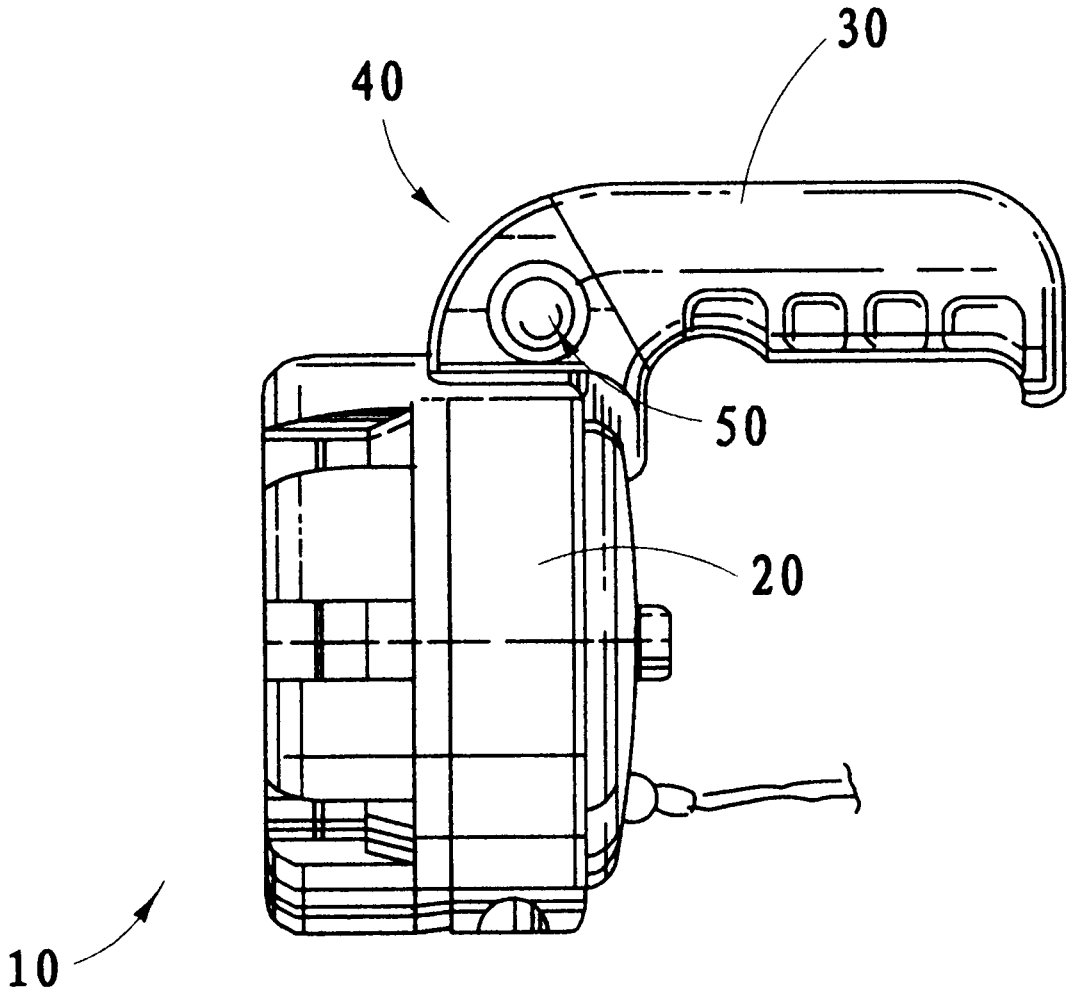
FIG. 4 is a side view of the swivel lantern, in a transversal type handle position, according to the above preferred embodiment of the present invention.

As shown in FIGS. 3 and 4, the swivel lantern 10 comprises a lamp head 20, a handle 30, a swivel joint 40 for rotatably connecting the handle 30 with the lamp head 20, and a releasable locking means 50 for selectively locking the handle 30 in a pistol type handle position and a transversal type handle position with respect to the lamp head 20.

In the pistol type handle position, as shown in FIG. 3, the handle 30 is sidewardly and radially extended from the lamp head 20. In the transversal type handle position, as shown in FIG. 4, the handle 30 is sidewardly extended in parallel with an axis of the lamp head 20.

Figure 5:
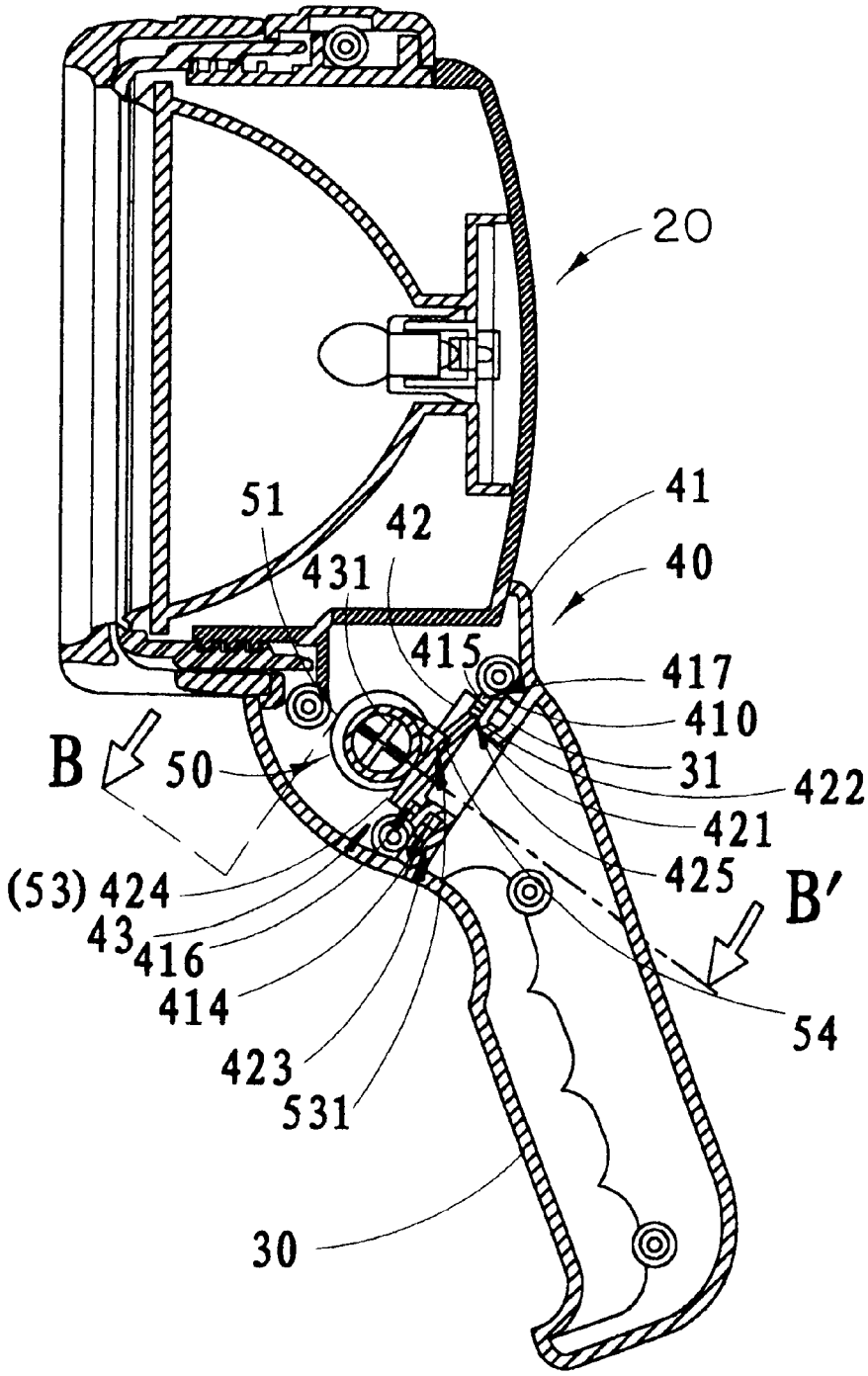
FIG. 5 is a sectional side view of the swivel lantern according to the above preferred embodiment of the present invention.
Figure 6:
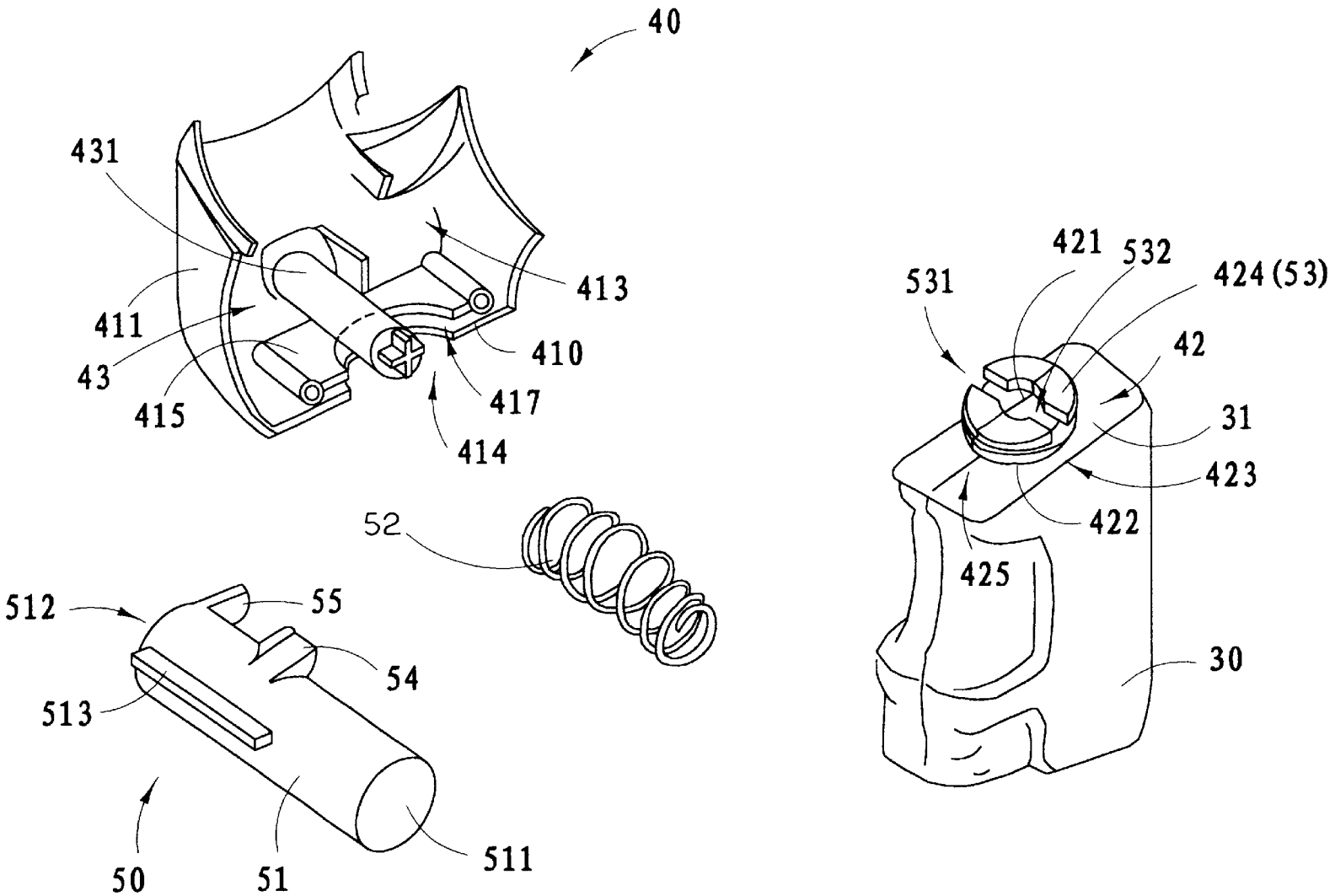
FIG. 6 is a partial exploded view of the swivel joint of the swivel lantern according to the above preferred embodiment of the present invention, illustrating one half of the swivel joint.
Figure 7:
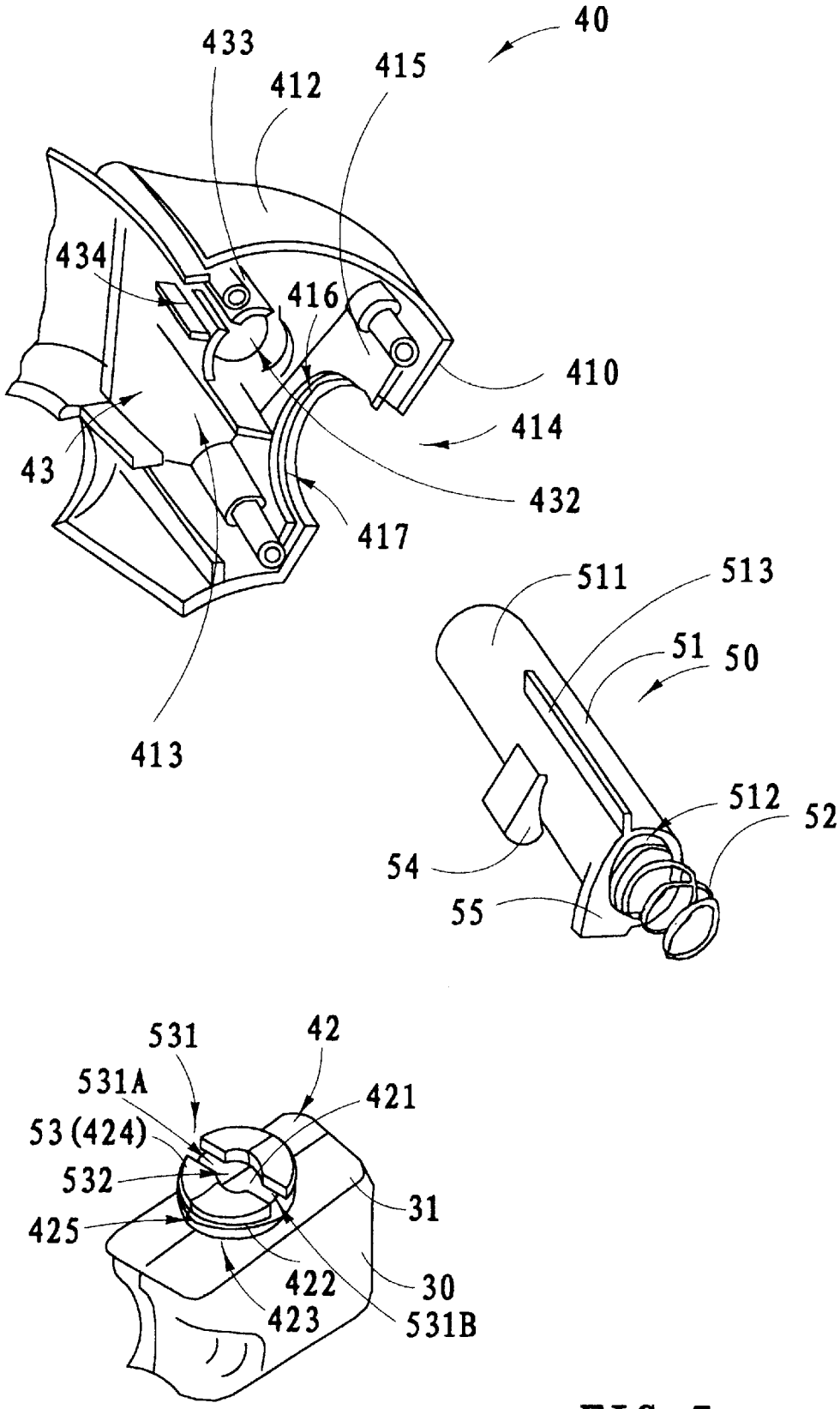
FIG. 7 is another partial exploded view of the swivel joint of the swivel lantern according to the above preferred embodiment of the present invention, illustrating another half of the swivel joint.

Referring to FIGS. 5 to 7, the swivel joint 40 comprises a joint housing 41 radially provided at a peripheral side of the lamp head 20 and a swivel head 42 integrally provided on a connection end wall 31 of the handle 30, wherein the swivel head 42 is arranged to rotatably connect in the joint housing 41.

The joint housing 41 is made of two symmetrical housing cases 411, 412 integrally connected together in an edge to edge manner to define a receiving chamber 413 therein. A neck hole 414 is formed at a connecting end wall 410 of the joint housing 41. Moreover, a supporting wall 415 is integrally and parallelly provided above the connecting end wall 410 within the receiving chamber 413. The supporting wall 415 also has a joint hole 416 which has the same diameter of the neck hole 415 and is positioned coaxially with the neck hole 414 so as to define circular holding groove 417 between the connecting end wall 410 and the supporting wall 415.

The connection end wall 31 is preferred to be inclined with an axial of the handle 30 in 45 degree. Symmetrically, the connecting end wall 410 of the joint housing 41 is also preferred to be inclined with the axial of the lamp head 20 in 45 degree. Accordingly, the connecting end wall 410 of the joint housing 41 of the lamp head 40 can be remained in contact with the connection end wall 31 of the handle 30, no matter the handle 30 is positioned, with respect to the lamp head 20, in the pistol type handle position as shown in FIG. 3 and in the transversal type handle position as shown in FIG. 4.

Referring to FIGS. 5 to 7, the swivel head 42, which is integrally protruded from the connection end wall 31 of the handle 30, comprises a cylindrical head axle 421 being perpendicularly protruded from the connection end wall 31 and having a diameter equal to or slightly smaller than that of the neck hole 414 and joint hole 416, a circular neck rib 422 radially protruded from the head axle 421 to define a first swivel groove 423 between the connection end wall 31 and the neck rib 422. When the two housing cases 411, 412 are connected edge to edge together, the neck rib 422 of the swivel head 42 of the swivel joint 40 should be positioned in the holding groove 417 of the joint housing 41 of the swivel joint 40 and a ring portion, around the neck hole 414, of the connecting end wall 410 will also be rotatably inserted and engaged in the swivel groove 423. Therefore, the swivel head 42 is rotatably held in position by the joint housing 41 so as to rotatably connect the handle 30 with the lamp head 20.

In order to more firmly hold the handle 30 in a rotatable manner, the swivel head 42 further comprises a holder disc 424 which has a diameter larger than the head axle 421 and is coaxially provided at a free end of the head axle 421 so as to define a holding groove 425 between the neck rib 422 and the holder disc 424 for receiving a ring portion, around the joint hole 416, of the supporting wall 415 therein. So that, the swivel head 42 and the joint housing 41 are mutually and rigidly engaged with each other in such a rotatable manner that the handle 30 is capable of supporting the weight of the lamp head 20.

In order to lock the handle 30 at predetermined positions with respect to the lamp head 20, the locking means 50 must be employed to releasably lock up the handle 30 for any unwanted rotation when the handle 30 is in the pistol type handle position as shown in FIG. 3 and the transversal type handle position as shown in FIG. 4. In order to minimize the cost and facilitate the handle switching operation, the locking means 50 is preferred to be designed with as less elements as possible and being operated effectively.

As shown in FIGS. 5 to 7, according to the preferred embodiment of the present invention, the locking means 50 comprises a locking latch 51 transversally supported by a supporting means 43 of the joint housing 41 inside the receiving chamber 413, a resilient element 52 for normally retaining the locking latch 51 at a locking position, and a locking disc 53 provided on the handle 30. According to the preferred embodiment of the present invention, the holder disc 424 of the swivel head 42 is also functioned as the locking disc 53 to incorporated with the locking latch 51. Normally, the locking latch 51 is normally retained by the resilient element to engage with the locking disc 53 so as to lock up the position of the handle 30, e.g. the pistol type handle position as shown in FIG. 3. Also, the engagement relationship between locking latch 51 and the locking disc is arranged to be temporarily releasable for rotating the handle 30 from one position to another, such as from the pistol type handle position to the transversal type handle position, i.e. by rotating the handle 30 about the axis of the swivel head 42 for 180 degree. After the adjustment, the locking latch 51 will be automatically engaged with the locking disc 53 again by means of the resilient element 52 so as to lock up the transversal type handle position.

Referring to FIGS. 5 to 9C, according to the preferred embodiment of the present invention, the locking latch 51 is a tubular body forming a button portion 511 at one end and an opening 512 at another end, wherein the resilient element 52 is a compressive spring adapted to be inserted in the locking latch 51 through the opening 512, as shown in FIG. 7. As shown in FIGS. 6 and 7, the supporting means 43 comprises a supporting post 431 integrally and transversally protruded from one of the housing case 411 and a supporting hole 432 provided on the other housing case 412. When connecting the two housing cases 411, 412, the supporting post 431 is arranged to insert into the locking latch 51 through the opening 512 and the button portion 511 is arranged to penetrate out the supporting hole 432 so as to transversally supporting the locking latch 51 within the joint housing 41 while the button portion 511 is extended out of the joint housing 41 through the supporting hole 432 to enable a user to press on it easily. Moreover, the supporting post 431 inserted into the locking latch 51 presses against the resilient element 52 so as to retain the resilient element 52 inside the locking latch 51 so as to provide a pressing force to push the button portion 511 of the locking latch 51 away from the supporting post 431 and remain outside the joint housing 41.

The locking means 50 further comprises a locker button 54 integrally and radially protruded from a middle position of the locking latch 51. With respect to the locker button 54, a locker groove 531 is transversally provided on the locking disc 53, wherein a width of the locker groove 531 must be equal to or slightly larger than a thickness of the locker button 54. However, a width of the locker button 54 must be larger than the locker groove 531 so that once the locker button 54 is placed in the locker groove 531, the locker button 54 is prevented from any rotation and limited to linearly movement along the locker groove 531. A central swivel round groove 532 is formed coaxially on the locking disc 53 which has a diameter equal to or slightly larger than the width of the locker button 54 and divides the locker groove 531 into a first section 531A and a second section 531B positioned at two sides of the central swivel round groove 532.

Figure 8A:
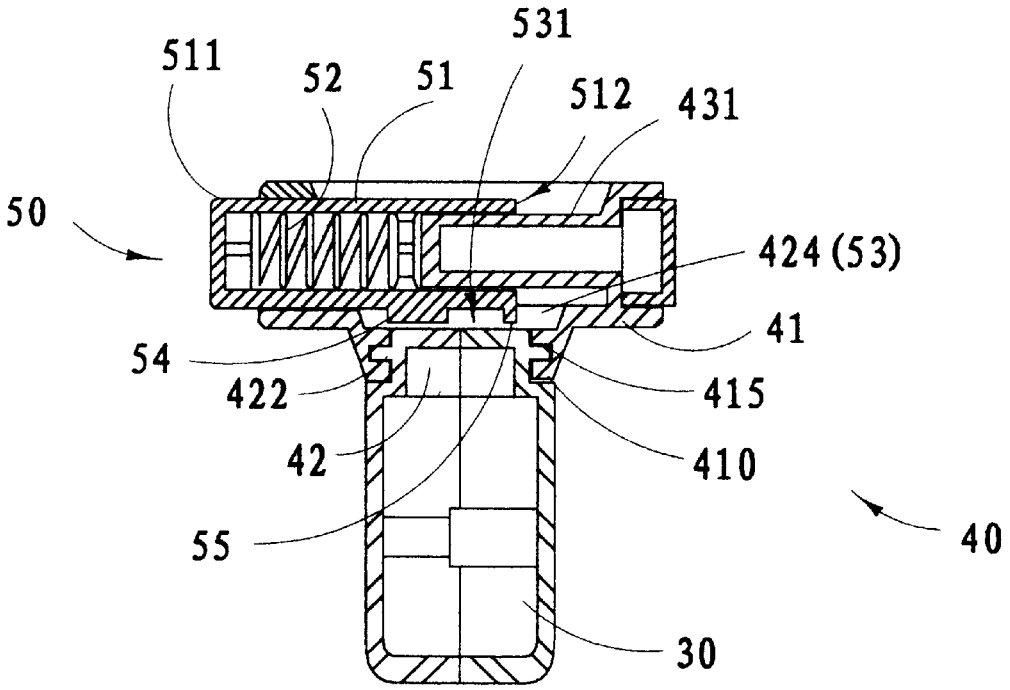
FIG. 8A is a sectional view, along the sectional line B–B' in FIG. 7, illustrating the releasable locking means of the swivel lantern according to the above preferred embodiment of the present invention.
Figure 9A:
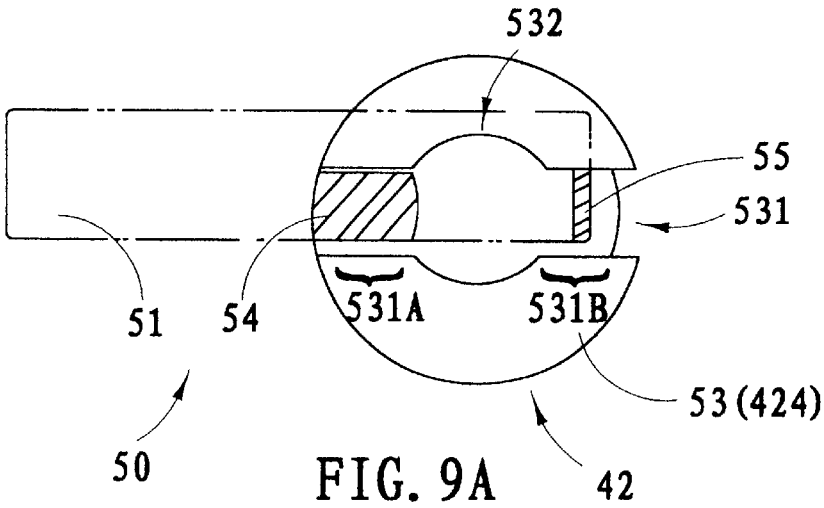
FIG. 9A is a schematic view illustrating a locking condition of the releasable locking means according to the above preferred embodiment of the present invention.

As shown in FIGS. 5, 8A and 9A, the locking latch 51 is supported transversally inside the joint housing 41 in an axially movable manner that the locker button 54 is placed in the first section 531A of the locker groove 531, so that the swivel head 42 and the handle 30 is locked up for any rotation movement. In other words, the handle 30 is unable to rotate about the axis of the swivel head 42 with respect to the lamp head 20 since the swivel head 42 is blocked by the locker button 54.

In order to better balance the blocking of the rotation of the swivel head 42 by the locking latch 51, the locking means 50 further comprises an additional locker rib 55 protruded from at the end having the opening 512 of the locking latch 51, wherein the locker rib 55 is arranged to be spacedly and parallelly positioned with the locker button 54, wherein the locker rib 55 is arranged to be positioned in the second section 531B of the locker groove 531 when the locker button 54 is positioned in the first section 531A of the locker groove 531, as shown in FIG. 9A. Therefore, the rotation of the swivel head 42 and the handle 30 is evenly blocked by the locker button 54 and the locker rib 55 normally.

Around the supporting hole 432, as shown in FIG. 7, it is preferred to have a supporting sleeve 433 protruded inwardly from the housing case 412 to help supporting the locking latch 51. In order to the linear movement of the locking latch 51 along its axis, the guiding rib 513 is longitudinally protruded on the locking latch 51, extending from the opening end 512 to a portion before the button portion 511. Also, a guiding slot 434 is longitudinally extended on the supporting sleeve 433 with respect to the position of the guiding rib 513 of locking latch 51, wherein the guiding rib 513 is arranged to extend into the guiding slot 434 so as to guide the locking latch 51 to move linearly along its axis without any rotation. Therefore, the user may push the locking latch 51 towards the first housing case 411 along the supporting post 431 by pressing into the button portion 511, wherein the resilient element 52 is compressed by the pushing force of the user. When the pushing force of the user releases, the resilient element 52 will rebound and press the locking latch 51 to move away from the supporting post 431 where the linear movement of the locking latch 51 is being guided by the relationship between guiding slot 434 and the guiding rib 513.

Figure 8B:
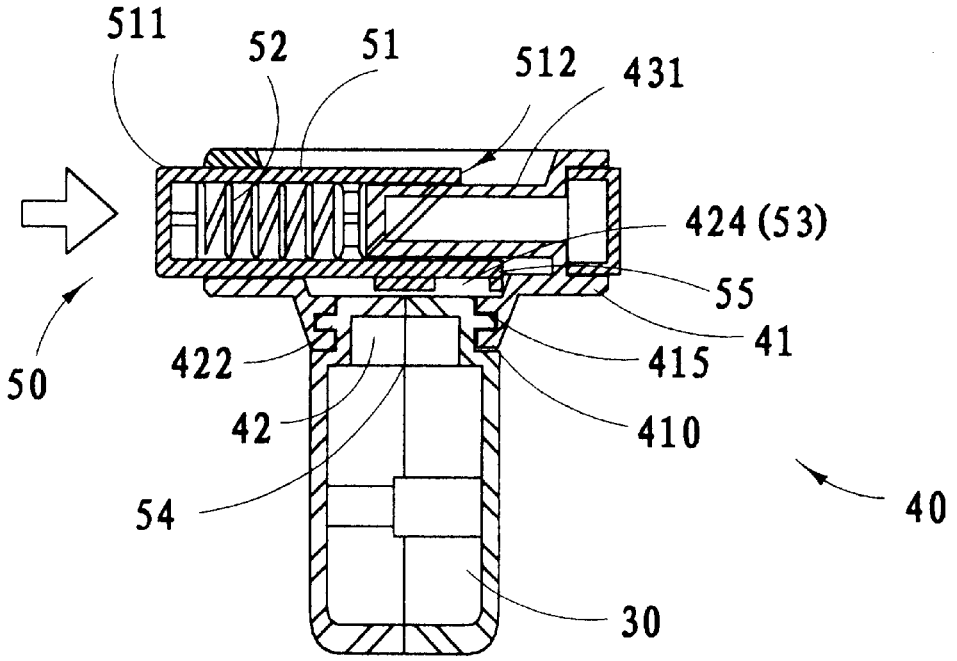
FIG. 8B is a sectional view, along the sectional line B–B' in FIG. 7, illustrating the releasable locking means when it is released according to the above preferred embodiment of the present invention.
Figure 9B:
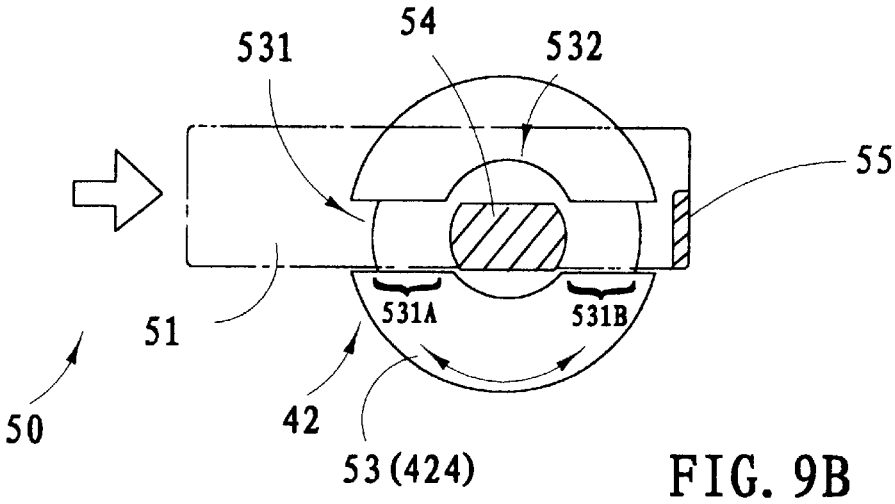
FIG. 9B is a schematic view illustrating an unlocking condition of the releasable locking means according to the above preferred embodiment of the present invention.

Accordingly, when the user pushes in the button portion 511 of the locking latch 51, as shown in FIGS. 8B and 9B, the resilient element 52 is compressed and the swivel joint 40 is operated to an unlocking condition, wherein the locker button 54 is driven to position in the central swivel round groove 532 and the locker rib 55 is driven to position outside the locker groove 531. While the user maintains the pressing force applied to the button portion 511 of the locking latch 51, the blocking of the locker button 54 and the locker rib 55 with respect to the swivel head 42 and the handle 30 is released and the handle 30 and the swivel head 42 is allowed to freely rotate about the axis of the swivel head 42, as shown in FIG. 9C.

Figure 9C:
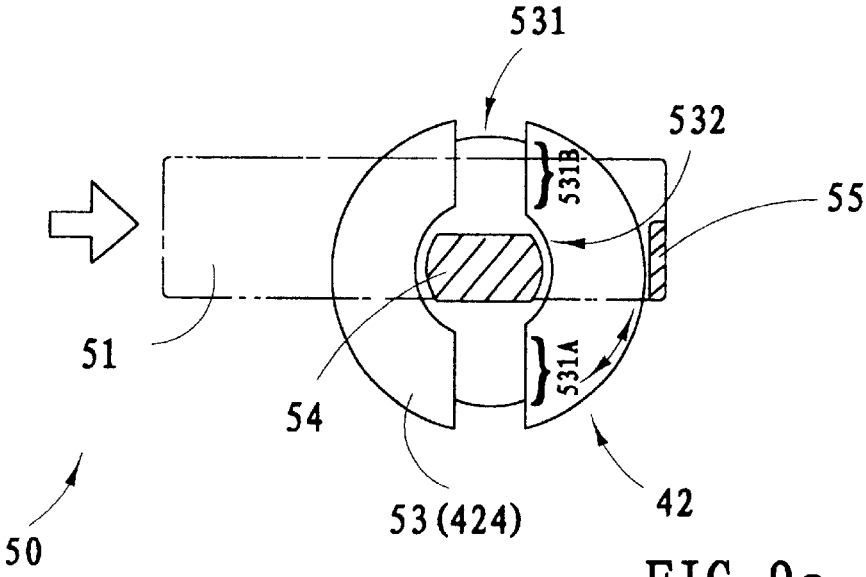
FIG. 9C is a schematic view illustrating a rotating handle during the unlocking condition of the releasable locking means according to the above preferred embodiment of the present invention.

During the rotation, as shown in FIG. 9C, the locking latch 51 is blocked by the locking disc 53 in the unlocking condition. Until the handle 30 and the swivel head 42 is rotated for 180 degree, the locker groove 31 is lined up with the locker button 54 and the locker rib 55 again and the unlocking condition of the swivel joint 40 is released automatically, wherein the resilient element 52 will rebound the locking latch 51 back to its normal locking condition, wherein the locker button 54 becomes positioned at the second section 531B of the locker groove 531 while the locker rib 55 is positioned at the first section 531A of the locker groove 531.

In view of above, the handle 30 is normally locked up at a desired position, either the pistol type handle position as shown in FIG. 4 or the transversal type handle position as shown in FIG. 5. However, the user may release the locking condition any time simply by pressing in the button portion 511 of the locking latch 51. Then, the user may rotate the handle 30 about the swivel head 42 for 180 degree to switch the swivel lantern to the other working position. In other words, the same swivel lantern can be worked and functioned as an above-head type lantern and a below-waist type lantern. Moreover, since the swivel head 42 is used both for rotatably connecting the handle with the lamp head 20 and for locking up the position of the handle by incorporating with the locking latch 51, the minimum number of parts is employed to minimize the cost of the effective locking structure that can easily be released while switching between the pistol type handle position and the transversal type handle position.

Figure 10:
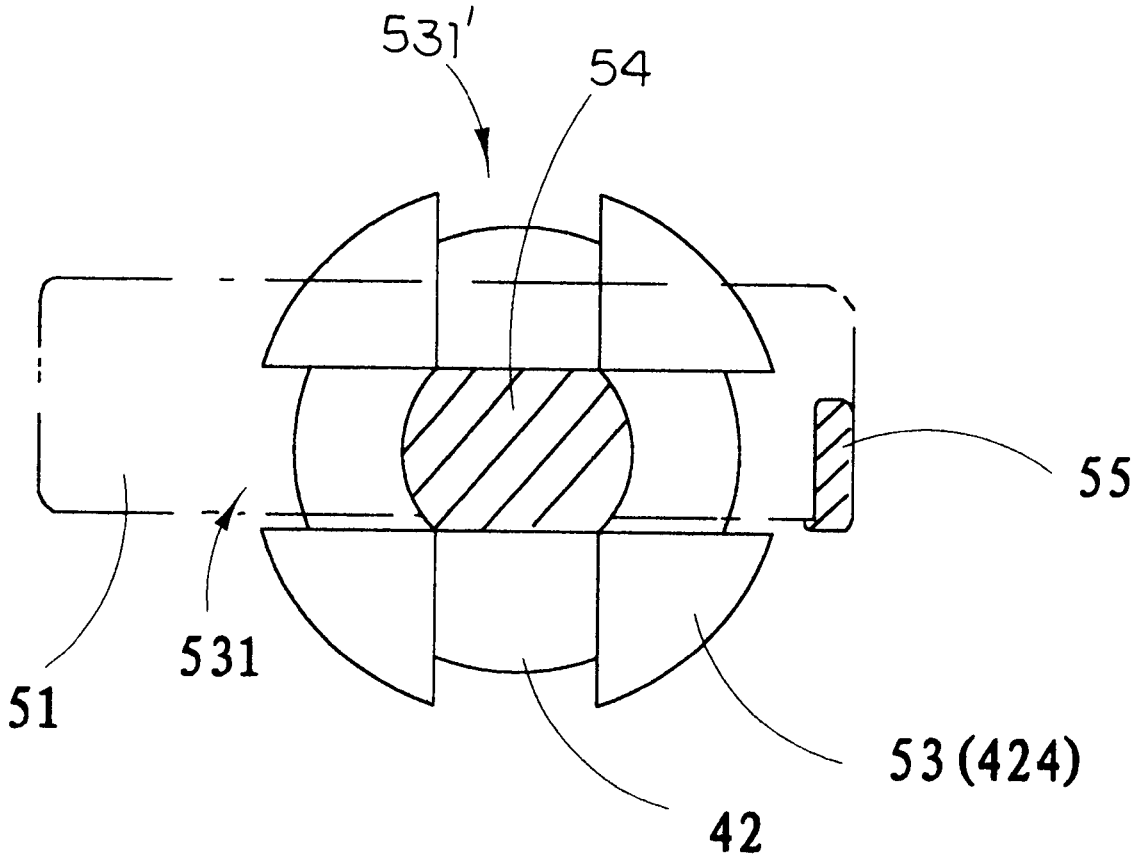
FIG. 10 is a schematic view illustrating an alternative mode of the above preferred embodiment according to the present invention.

As shown in FIG. 10, an alternative mode of the locking means 50 is illustrated, wherein two locker grooves 531, 531' are perpendicularly provided in cross manner so that the handle 30 can be locked up in every 90 degrees.

What is claimed is:

1. A swivel lantern, comprising:

a lamp head, a handle, a swivel joint for rotatably connecting said handle with said lamp head, wherein said swivel joint comprises a joint housing radially provided at a peripheral side of said lamp head and a swivel head integrally provided on a connection end wall of said handle, wherein said swivel head is arranged to rotatably connect to said joint housing, wherein a receiving chamber is provided in said joint housing, a neck hole is formed at a connecting end wall of said joint housing, and a supporting wall is integrally and parallelly provided above said connecting end wall within said receiving chamber, wherein said supporting wall also has a joint hole which has the same diameter of said neck hole and is positioned coaxially with said neck hole so as to define a circular holding groove between said connecting end wall and said supporting wall, wherein said swivel head, which is integrally protruded from said connection end wall of said handle, comprises a cylindrical head axle perpendicularly protruded from said connection end wall, a circular neck rib radially protruded from said head axle to define a first swivel groove between said connection end wall and said neck rib, wherein said neck rib of said swivel head of said swivel joint is positioned in said holding groove of said joint housing of said swivel joint and a first ring portion, around said neck hole, of said connecting end wall is rotatably inserted and engaged in said swivel groove, therefore said swivel head is rotatably held in position by said joint housing so as to rotatably connect said handle with said lamp head, wherein said swivel head further comprises a holder disc which has a diameter larger than said head axle and is coaxially provided at a free end of said head axle so as to define a holder groove between said neck rib and said holder disc for receiving a second ring portion, around said joint hole, of said supporting wall therein; and a releasable locking means for selectively locking said handle in a pistol type handle position or transversal type handle position with respect to said lamp head, wherein in said pistol type handle position, said handle is sidewardly and radially extended from said lamp head, and in said transversal type handle position, said handle is sidewardly extended in parallel with an axis of said lamp head, wherein said locking means is employed to releasably lock said handle from any unwanted rotation when said handle is in said pistol type handle position and said transversal type handle position.

2. The swivel lantern, as recited in claim 1, wherein said locking means comprises a locking latch transversally supported by a supporting means of said joint housing inside said receiving chamber, a resilient element normally retaining said locking latch at a locking position, and a locking disc, wherein said locking latch is normally retained by said resilient element to engage with said locking disc so as to lock up said handle in said pistol type handle position or said transversal type handle position, however an engagement relationship between said locking latch and said locking disc is arranged to be temporarily releasable for rotating said handle from said pistol type handle position to said transversal type handle or vice verse, wherein after adjustment, said locking latch is automatically engaged with said locking disc again by means of said resilient element.

3. The swivel lantern, as recited in claim 2, wherein said locking means further comprises a locker button integrally and radially protruded from said locking latch, wherein with respect to said locker button, a locker groove is transversally provided on said locking disc, wherein a width of said locker groove is at least equal to a thickness of said locker button and a width of said locker button is larger than said locker groove, wherein said locking latch is supported transversally inside said joint housing in an axially movable manner that said locker button is placed in said locker groove, and thus said locker button is prevented from rotation and limited to linearly movement along said locker groove, moreover a central swivel round groove is formed coaxially on said locking disc which has a diameter at least equal to said width of said locker button and divides said locker groove into a first section and a second section positioned at two sides of said central swivel round groove, wherein when said button portion of said locking latch is pressed, said resilient element is compressed and said locker button is driven to position in said central swivel round groove, so that said swivel joint is operated to an unlocking condition and said handle is allowed to freely rotate about said swivel head.

4. The swivel lantern, as recited in claim 3, wherein said locking latch is a tubular body forming a button portion at one end and an opening at another end and said resilient element is a compressive spring adapted to be inserted in said locking latch through said opening, wherein said supporting means comprises a supporting post integrally and transversally protruded from one of said housing case and a supporting hole provided on said other housing case, wherein said supporting post is arranged to insert into said locking latch through said opening and said button portion is arranged to penetrate out said supporting hole so as to transversally supporting said locking latch within said joint housing while said button portion is extended out of said joint housing through said supporting hole, moreover said supporting post is inserted into said locking latch to press against said resilient element so as to retain said resilient element inside said locking latch so as to provide a pressing force to push said button portion of said locking latch away from said supporting post and remain outside said joint housing.

5. The swivel lantern, as recited in claim 4, wherein a guiding rib is longitudinally protruded on said locking latch and, around said supporting hole, a supporting sleeve is protruded inwardly from a side wall of said joint housing and a guiding slot is longitudinally extended on said supporting sleeve with respect to said guiding rib of locking latch, wherein said guiding rib is arranged to extend into said guiding slot so as to guide said locking latch to move linearly along an axis thereof without rotation.

6. The swivel lantern, as recited in claim 3, wherein said locking means further comprises an additional locker rib, which is protruded from said locking latch and arranged to be spacedly and parallelly with said locker button, wherein said locker rib is arranged to be positioned in one end of said locker groove when said locker button is positioned in another end of said locker groove, wherein when said button portion of said locking latch is pressed, said locker rib is driven to move away from said locker groove so that said swivel joint is allowed to freely rotate about said swivel head.

7. The swivel lantern, as recited in claim 6, wherein said locking latch is a tubular body forming a button portion at one end and an opening at another end and said resilient element is a compressive spring adapted to be inserted in said locking latch through said opening, wherein said locker button is protruded at a middle position of said locking latch while said locker rib is protruded at said end having said opening of said locking latch, wherein said supporting means comprises a supporting post integrally and transversally protruded from one of said housing case and a supporting hole provided on said other housing case, wherein said supporting post is arranged to insert into said locking latch through said opening and said button portion is arranged to penetrate out said supporting hole so as to transversally supporting said locking latch within said joint housing while said button portion is extended out of said joint housing through said supporting hole, moreover said supporting post is inserted into said locking latch to press against said resilient element so as to retain said resilient element inside said locking latch so as to provide a pressing force to push said button portion of said locking latch away from said supporting post and remain outside said joint housing.

8. The swivel lantern, as recited in claim 7, wherein a guiding rib is longitudinally protruded on said locking latch and, around said supporting hole, a supporting sleeve is protruded inwardly from a side wall of said joint housing and a guiding slot is longitudinally extended on said supporting sleeve with respect to said guiding rib of locking latch, wherein said guiding rib is arranged to extend into said guiding slot so as to guide said locking latch to move linearly along an axis thereof without rotation.

9. A swivel lantern, comprising:

a lamp head, a handle, a swivel joint for rotatably connecting said handle with said lamp head, wherein said swivel joint comprises a joint housing radially provided at a peripheral side of said lamp head and a swivel head integrally provided on a connection end wall of said handle, wherein said swivel head is arranged to rotatably connect to said joint housing, wherein a receiving chamber is provided in said joint housing, a neck hole is formed at a connecting end wall of said joint housing, and a supporting wall is integrally and parallelly provided above said connecting end wall within said receiving chamber, wherein said supporting wall also has a joint hole which has the same diameter of said neck hole and is positioned coaxially with said neck hole so as to define a circular holding groove between said connecting end wall and said supporting wall, wherein said swivel head, which is integrally protruded from said connection end wall of said handle, comprises a cylindrical head axle perpendicularly protruded from said connection end wall, a circular neck rib radially protruded from said head axle to define a first swivel groove between said connection end wall and said neck rib, wherein said neck rib of said swivel head of said swivel joint is positioned in said holding groove of said joint housing of said swivel joint and a first ring portion, around said neck hole, of said connecting end wall is rotatably inserted and engaged in said swivel groove, therefore said swivel head is rotatably held in position by said joint housing so as to rotatably connect said handle with said lamp head, wherein said connection end wall is inclined with an axis of said handle at a 45 degree and said connecting end wall of said joint housing is also inclined with an axis of said lamp head at a 45 degree, so that said connecting end wall of said joint housing of said lamp head is remained in contact with said connection end wall of said handle when said handle is positioned, with respect to said lamp head, both in said pistol type handle position and in said transversal type handle position, wherein said swivel head further comprises a holder disc which has a diameter larger than said head axle and is coaxially provided at a free end of said head axle so as to define a holder groove between said neck rib and said holder disc for receiving a second ring portion, around said joint hole, of said supporting wall therein; and a releasable locking means for selectively locking said handle in a pistol type handle position or transversal type handle position with respect to said lamp head, wherein in said pistol type handle position, said handle is sidewardly and radially extended from said lamp head, and in said transversal type handle position, said handle is sidewardly extended in parallel with an axis of said lamp head, wherein said locking means is employed to releasably lock said handle from any unwanted rotation when said handle is in said pistol type handle position and said transversal type handle position.

10. The swivel lantern, as recited in claim 9, wherein said joint housing is made of two symmetrical housing cases integrally connected together in an edge to edge manner to define said receiving chamber therein.

11. The swivel lantern, as recited in claim 10, wherein said locking means comprises a locking latch transversally supported by a supporting means of said joint housing inside said receiving chamber, a resilient element normally retaining said locking latch at a locking position, and a locking disc, wherein said locking latch is normally retained by said resilient element to engage with said locking disc so as to lock up said handle in said pistol type handle position or said transversal type handle position, however an engagement relationship between said locking latch and said locking disc is arranged to be temporarily releasable for rotating said handle from said pistol type handle position to said transversal type handle or vice verse, wherein after adjustment, said locking latch is automatically engaged with said locking disc again by means of said resilient element.

12. The swivel lantern, as recited in claim 11, wherein said locking means further comprises a locker button integrally and radially protruded from said locking latch, wherein with respect to said locker button, a locker groove is transversally provided on said locking disc, wherein a width of said locker groove is at least equal to a thickness of said locker button and a width of said locker button is larger than said locker groove, wherein said locking latch is supported transversally inside said joint housing in an axially movable manner that said locker button is placed in said locker groove, and thus said locker button is prevented from rotation and limited to linearly movement along said locker groove, moreover a central swivel round groove is formed coaxially on said locking disc which has a diameter at least equal to said width of said locker button and divides said locker groove into a first section and a second section positioned at two sides of said central swivel round groove, wherein when said button portion of said locking latch is pressed, said resilient element is compressed and said locker button is driven to position in said central swivel round groove, so that said swivel joint is operated to an unlocking condition and said handle is allowed to freely rotate about said swivel head.

13. The swivel lantern, as recited in claim 12, wherein said locking latch is a tubular body forming a button portion at one end and an opening at another end and said resilient element is a compressive spring adapted to be inserted in said locking latch through said opening, wherein said supporting means comprises a supporting post integrally and transversally protruded from one of said housing case and a supporting hole provided on said other housing case, wherein said supporting post is arranged to insert into said locking latch through said opening and said button portion is arranged to penetrate out said supporting hole so as to transversally supporting said locking latch within said joint housing while said button portion is extended out of said joint housing through said supporting hole, moreover said supporting post is inserted into said locking latch to press against said resilient element so as to retain said resilient element inside said locking latch so as to provide a pressing force to push said button portion of said locking latch away from said supporting post and remain outside said joint housing.

14. The swivel lantern, as recited in claim 13, wherein a guiding rib is longitudinally protruded on said locking latch and, around said supporting hole, a supporting sleeve is protruded inwardly from a side wall of said joint housing and a guiding slot is longitudinally extended on said supporting sleeve with respect to said guiding rib of locking latch, wherein said guiding rib is arranged to extend into said guiding slot so as to guide said locking latch to move linearly along an axis thereof without rotation.

15. The swivel lantern, as recited in claim 12, wherein said locking means further comprises an additional locker rib, which is protruded from said locking latch and arranged to be spacedly and parallelly with said locker button, wherein said locker rib is arranged to be positioned in one end of said locker groove when said locker button is positioned in another end of said locker groove, wherein when said button portion of said locking latch is pressed, said locker rib is driven to move away from said locker groove so that said swivel joint is allowed to freely rotate about said swivel head.

16. The swivel lantern, as recited in claim 15, wherein said locking latch is a tubular body forming a button portion at one end and an opening at another end and said resilient element is a compressive spring adapted to be inserted in said locking latch through said opening, wherein said locker button is protruded at a middle position of said locking latch while said locker rib is protruded at said end having said opening of said locking latch, wherein said supporting means comprises a supporting post integrally and transversally protruded from one of said housing case and a supporting hole provided on said other housing case, wherein said supporting post is arranged to insert into said locking latch through said opening and said button portion is arranged to penetrate out said supporting hole so as to transversally supporting said locking latch within said joint housing while said button portion is extended out of said joint housing through said supporting hole, moreover said supporting post is inserted into said locking latch to press against said resilient element so as to retain said resilient element inside said locking latch so as to provide a pressing force to push said button portion of said locking latch away from said supporting post and remain outside said joint housing.

17. The swivel lantern, as recited in claim 16, wherein a guiding rib is longitudinally protruded on said locking latch and, around said supporting hole, a supporting sleeve is protruded inwardly from a side wall of said joint housing and a guiding slot is longitudinally extended on said supporting sleeve with respect to said guiding rib of locking latch, wherein said guiding rib is arranged to extend into said guiding slot so as to guide said locking latch to move linearly along an axis thereof without rotation.

18. The swivel lantern, as recited in claim 9, wherein said locking means comprises a locking latch transversally supported by a supporting means of said joint housing inside said receiving chamber, a resilient element for normally retaining said locking latch at a locking position, and a locking disc which is said holder disc, wherein said locking latch is normally retained by said resilient element to engage with said locking disc so as to lock up said handle in said pistol type handle position or said transversal type handle position, however an engagement relationship between said locking latch and said locking disc is arranged to be temporarily releasable for rotating said handle from said pistol type handle position to said transversal type handle or vice verse, wherein after adjustment, said locking latch is automatically engaged with said locking disc again by means of said resilient element.

19. The swivel lantern, as recited in claim 18, wherein said locking means further comprises a locker button integrally and radially protruded from said locking latch, wherein with respect to said locker button, a locker groove is transversally provided on said locking disc, wherein a width of said locker groove is at least equal to a thickness of said locker button and a width of said locker button is larger than said locker groove, wherein said locking latch is supported transversally inside said joint housing in an axially movable manner that said locker button is placed in said locker groove, and thus said locker button is prevented from rotation and limited to linearly movement along said locker groove, moreover a central swivel round groove is formed coaxially on said locking disc which has a diameter at least equal to said width of said locker button and divides said locker groove into a first section and a second section positioned at two sides of said central swivel round groove, wherein when said button portion of said locking latch is pressed, said resilient element is compressed and said locker button is driven to position in said central swivel round groove, so that said swivel joint is operated to an unlocking condition and said handle is allowed to freely rotate about said swivel head.

20. The swivel lantern, as recited in claim 19, wherein said locking latch is a tubular body forming a button portion at one end and an opening at another end and said resilient element is a compressive spring adapted to be inserted in said locking latch through said opening, wherein said supporting means comprises a supporting post integrally and transversally protruded from one of said housing case and a supporting hole provided on said other housing case, wherein said supporting post is arranged to insert into said locking latch through said opening and said button portion is arranged to penetrate out said supporting hole so as to transversally supporting said locking latch within said joint housing while said button portion is extended out of said joint housing through said supporting hole, moreover said supporting post is inserted into said locking latch to press against said resilient element so as to retain said resilient element inside said locking latch so as to provide a pressing force to push said button portion of said locking latch away from said supporting post and remain outside said joint housing.

21. The swivel lantern, as recited in claim 20, wherein a guiding rib is longitudinally protruded on said locking latch and, around said supporting hole, a supporting sleeve is protruded inwardly from a side wall of said joint housing and a guiding slot is longitudinally extended on said supporting sleeve with respect to said guiding rib of locking latch, wherein said guiding rib is arranged to extend into said guiding slot so as to guide said locking latch to move linearly along an axis thereof without rotation.

22. The swivel lantern, as recited in claim 19, wherein said locking means further comprises an additional locker rib, which is protruded from said locking latch and arranged to be spacedly and parallelly with said locker button, wherein said locker rib is arranged to be positioned in one end of said locker groove when said locker button is positioned in another end of said locker groove, wherein when said button portion of said locking latch is pressed, said locker rib is driven to move away from said locker groove so that said swivel joint is allowed to freely rotate about said swivel head.

23. The swivel lantern, as recited in claim 22, wherein said locking latch is a tubular body forming a button portion at one end and an opening at another end and said resilient element is a compressive spring adapted to be inserted in said locking latch through said opening, wherein said locker button is protruded at a middle position of said locking latch while said locker rib is protruded at said end having said opening of said locking latch, wherein said supporting means comprises a supporting post integrally and transversally protruded from one of said housing case and a supporting hole provided on said other housing case, wherein said supporting post is arranged to insert into said locking latch through said opening and said button portion is arranged to penetrate out said supporting hole so as to transversally supporting said locking latch within said joint housing while said button portion is extended out of said joint housing through said supporting hole, moreover said supporting post is inserted into said locking latch to press against said resilient element so as to retain said resilient element inside said locking latch so as to provide a pressing force to push said button portion of said locking latch away from said supporting post and remain outside said joint housing.

24. The swivel lantern, as recited in claim 22, wherein a guiding rib is longitudinally protruded on said locking latch and, around said supporting hole, a supporting sleeve is protruded inwardly from a side wall of said joint housing and a guiding slot is longitudinally extended on said supporting sleeve with respect to said guiding rib of locking latch, wherein said guiding rib is arranged to extend into said guiding slot so as to guide said locking latch to move linearly along an axis thereof without rotation.

25. A swivel lantern, comprising:

a lamp head, a handle, a swivel joint for rotatably connecting said handle with said lamp head, wherein said swivel joint comprises a joint housing radially provided at a peripheral side of said lamp head and a swivel head integrally provided on a connection end wall of said handle, wherein said joint housing is made of two symmetrical housing cases integrally connected together in an edge to edge manner to define said receiving chamber therein, wherein said swivel head is arranged to rotatably connect to said joint housing, wherein a receiving chamber is provided in said joint housing, a neck hole is formed at a connecting end wall of said joint housing, and a supporting wall is integrally and parallelly provided above said connecting end wall within said receiving chamber, wherein said supporting wall also has a joint hole which has the same diameter of said neck hole and is positioned coaxially with said neck hole so as to define a circular holding groove between said connecting end wall and said supporting wall, wherein said swivel head, which is integrally protruded from said connection end wall of said handle, comprises a cylindrical head axle perpendicularly protruded from said connection end wall, a circular neck rib radially protruded from said head axle to define a first swivel groove between said connection end wall and said neck rib, wherein said neck rib of said swivel head of said swivel joint is positioned in said holding groove of said joint housing of said swivel joint and a first ring portion, around said neck hole, of said connecting end wall is rotatably inserted and engaged in said swivel groove, therefore said swivel head is rotatably held in position by said joint housing so as to rotatably connect said handle with said lamp head, wherein said connection end wall is inclined with an axis of said handle at a 45 degree and said connecting end wall of said joint housing is also inclined with an axis of said lamp head at a 45 degree, so that said connecting end wall of said joint housing of said lamp head is remained in contact with said connection end wall of said handle when said handle is positioned, with respect to said lamp head, both in said pistol type handle position and in said transversal type handle position; and a releasable locking means for selectively locking said handle in a pistol type handle position or transversal type handle position with respect to said lamp head, wherein in said pistol type handle position, said handle is sidewardly and radially extended from said lamp head, and in said transversal type handle position, said handle is sidewardly extended in parallel with an axis of said lamp head, wherein said locking means is employed to releasably lock said handle from any unwanted rotation when said handle is in said pistol type handle position and said transversal type handle position.

26. The swivel lantern, as recited in claim 25, wherein said locking means comprises a locking latch transversally supported by a supporting means of said joint housing inside said receiving chamber, a resilient element normally retaining said locking latch at a locking position, and a locking disc, wherein said locking latch is normally retained by said resilient element to engage with said locking disc so as to lock up said handle in said pistol type handle position or said transversal type handle position, however an engagement relationship between said locking latch and said locking disc is arranged to be temporarily releasable for rotating said handle from said pistol type handle position to said transversal type handle or vice verse, wherein after adjustment, said locking latch is automatically engaged with said locking disc again by means of said resilient element.

27. A swivel lantern, comprising:

a lamp head, a handle, a swivel joint for rotatably connecting said handle with said lamp head, wherein said swivel joint comprises a joint housing radially provided at a peripheral side of said lamp head and a swivel head integrally provided on a connection end wall of said handle, wherein said swivel head is arranged to rotatably connect to said joint housing, wherein a receiving chamber is provided in said joint housing, a neck hole is formed at a connecting end wall of said joint housing, and a supporting wall is integrally and parallelly provided above said connecting end wall within said receiving chamber, wherein said supporting wall also has a joint hole which has the same diameter of said neck hole and is positioned coaxially with said neck hole so as to define a circular holding groove between said connecting end wall and said supporting wall, wherein said swivel head, which is integrally protruded from said connection end wall of said handle, comprises a cylindrical head axle perpendicularly protruded from said connection end wall, a circular neck rib radially protruded from said head axle to define a first swivel groove between said connection end wall and said neck rib, wherein said neck rib of said swivel head of said swivel joint is positioned in said holding groove of said joint housing of said swivel joint and a first ring portion, around said neck hole, of said connecting end wall is rotatably inserted and engaged in said swivel groove, therefore said swivel head is rotatably held in position by said joint housing so as to rotatably connect said handle with said lamp head; and a releasable locking means for selectively locking said handle in a pistol type handle position or transversal type handle position with respect to said lamp head, wherein in said pistol type handle position, said handle is sidewardly and radially extended from said lamp head, and in said transversal type handle position, said handle is sidewardly extended in parallel with an axis of said lamp head, wherein said locking means is employed to releasably lock said handle from any unwanted rotation when said handle is in said pistol type handle position and said transversal type handle position, wherein said locking means comprises a locking latch transversally supported by a supporting means of said joint housing inside said receiving chamber, a resilient element normally retaining said locking latch at a locking position, and a locking disc, wherein said locking latch is normally retained by said resilient element to engage with said locking disc so as to lock up said handle in said pistol type handle position or said transversal type handle position, however an engagement relationship between said locking latch and said locking disc is arranged to be temporarily releasable for rotating said handle from said pistol type handle position to said transversal type handle or vice verse, wherein after adjustment, said locking latch is automatically engaged with said locking disc again by means of said resilient element.

* * * * *